US005096435A

United States Patent [19]

Noschese et al.

[11] Patent Number: 5,096,435

[45] Date of Patent: Mar. 17, 1992

[54] BI-LEVEL CARD EDGE CONNECTOR WITH SELECTIVELY MOVABLE CONTACTS FOR USE WITH DIFFERENT TYPES OF CARDS

[75] Inventors: Rocco J. Noschese, Wilton; Heinz Piorunneck, Trumbull, both of Conn.

[73] Assignee: Burndy Corporation, Norwalk, Conn.

[21] Appl. No.: 637,046

[22] Filed: Jan. 3, 1991

[51] Int. Cl.[5] ..... H01R 13/15

[52] U.S. Cl. ..... 439/260; 439/325

[58] Field of Search ..... 439/59, 60, 260, 267, 439/325, 630, 633, 634, 635, 636, 637

[56] References Cited

U.S. PATENT DOCUMENTS

| | | | |
|---|---|---|---|
| 3,395,377 | 7/1968 | Strauss | 439/267 X |
| 3,912,353 | 10/1975 | Kasuya et al. | 439/637 X |
| 4,298,237 | 11/1981 | Griffith et al. | 439/60 |
| 4,546,414 | 10/1985 | Donges | 439/633 X |
| 4,863,395 | 9/1989 | Babuka et al. | 439/260 |

OTHER PUBLICATIONS

IBM Technical Bulletin, vol. 14, No. 9, Feb. 1972.

*Primary Examiner*—Neil Abrams
*Assistant Examiner*—Khiem Nguyen
*Attorney, Agent, or Firm*—Perman & Green

[57] ABSTRACT

A card edge connector that has a base, spring contacts connected to the base, and a cover movably mounted on the base. The cover is adapted to move at least some of the spring contacts from a retracted position to a contact position upon insertion of a first type of card into the connector and, adapted not to move spring contacts upon insertion of a second type of card into the connector. The cover is adapted to be moved by the first type of card, but not by the second type of card. Lateral support is provided to the cover by the base to prevent the cover from being substantially pushed laterally outward by the spring contacts. Clips on the cover are provided to prevent the first type of card from being removed from the connector without moving the cover.

31 Claims, 5 Drawing Sheets

BI-LEVEL CARD EDGE CONNECTOR WITH SELECTIVELY MOVABLE CONTACTS FOR USE WITH DIFFERENT TYPES OF CARDS

BACKGROUND OF THE INVENTION

1. Field of the Invention

The present invention relates to electrical connectors and, more particularly, to card edge connectors.

2. Prior Art

In the electrical arts it is a common practice to use a card edge connector to mechanically and electrically couple a mother printed circuit board with a daughter printed circuit board as of the vertical edge card variety. In such a practice, there has been an evolution towards placing electrical contacts closer and closer together while maintaining a high, constant stress between the electrical contacts and the areas to be contacted on the daughter board. In placing the contacts closer together, the width of each contact must decrease. This, in turn, makes it much more difficult to keep the proper contact stress between the contact and the areas to be contacted while also assuring proper alignment between the two upon insertion of the card edge into the connector. There has also developed a special type of connector which is known in the art as a bi-level connector; i.e.: a connector having two types of contacts that make contact with a daughter printed circuit board in two locations or at two levels. The two types of contacts are generally arranged in two opposing rows with a card edge receiving slot therebetween.

The high density card edge connector in the past encountered a problem in regard to the amount of force that was necessary to insert the edge of the daughter printed circuit board into the connector because each contact is a spring contact and it must be at least partially moved by the card edge and because there are more contacts in the high density connectors. The bi-level connector alleviated this problem, to a degree, by allowing for a two step engagement of the card edge with the contacts; the first step being the displacement of the upper first type of contacts and the second step being the displacement of the lower second types of contacts.

Another type of card edge connector known in the art is a zero insertion force (ZIF) connector that uses levers to move contacts into and out of a card receiving slot. One such connector is shown in U.S. Pat. No. 4,636,021. However, these types of connectors do not allow for the contacts to scrub against the daughter board to insure proper electrical contact therewith. U.S. Pat. No. 3,970,353 shows a clip for locking a daughter board in a connector. And U.S. Pat. No. 4,869,672 discloses a dual purpose card edge connector.

As illustrated by a great number of prior patents, as well as commercial devices, efforts are continuously being made in an attempt to improve connectors and their contacts to render them more efficient, effective and economical. None of these previous efforts, however, provides the benefits attendant with the present invention. The present invention achieves its intended purposes, objects and advantages over the prior art devices through a new, useful and unobvious combination of component elements, with the use of a negligible number of functioning parts and at a reasonable cost to manufacture.

SUMMARY OF THE INVENTION

The foregoing problems are overcome and other advantages are provided by a card edge connector having a movable cover adapted to move selective contacts into contact with a daughter board inserted into the connector.

In accordance with one embodiment of the present invention, a card edge connector is provided comprising a base, a cover, and means for moving the cover on the base. The base has a housing comprised of electrically insulating material and spring contacts connected thereto. The base housing has a card edge receiving slot therein. The cover is comprised of electrically insulating material movably mounted on the base between a first position and a second position. The cover has means for moving at least some of the spring contacts relative to the card edge receiving slot. The means for moving the cover on the base can move the cover upon insertion and removal of a daughter board card with the card edge receiving slot. The means for moving comprises at least one portion of the cover being adapted to be interactively contacted by the daughter board card and moved thereby.

In accordance with another embodiment of the present invention, a bi-level card edge connector adapted to be used in connecting a mother board with a daughter board of either a first type or a second type is provided. The connector comprises a housing having a card edge receiving area and spring contacts mounted to the housing. The spring contacts include upper contacts proximate an upper region of the card edge receiving area and lower contacts proximate a lower portion of the card edge receiving area. The connector further comprises means for allowing the lower spring contacts to contact either the first or second type of daughter boards upon insertion of one of the daughter boards into the receiving slot. The connector also comprises means for allowing the upper spring contacts to contact the first type of daughter board and for preventing the upper spring contacts from contacting the second type of daughter board upon insertion of one of the boards into the receiving slot.

In accordance with another embodiment of the present invention, a bi-level card edge connector adapted to be used in making mechanical and electrical connection between a mother board and a daughter board of either a first type or a second type is provided. The connector comprises a housing, spring contacts, and means for selectively moving spring contacts. The housing is comprised of dielectric material having a card edge receiving area. The spring contacts are mounted to the housing and include a first type of contact projecting into the receiving area in a home position and a second type of contact being spaced from the receiving area in a home position. The means for selectively moving can move the second type of contacts into the card edge receiving area upon insertion of the first type of daughter board into the receiving area, but allowing the second type of contact to remain spaced from the receiving area upon insertion of the second type of daughter board into the receiving area.

In accordance with another embodiment of the present invention, a daughter board edge connector is provided. The connector comprises a base, a cover, and means for laterally supporting the cover along its length. The base has a housing with a longitudinal shape and a card edge receiving slot and, spring contacts connected thereto. The cover has a longitudinal length and is movably mounted on the base housing and adapted to move at least some of the spring contacts relative to the receiving slot. The means for laterally supporting can support the cover along its length and comprises predetermined portions of the cover being interlocked with predetermined portions of the base along longitudinal sides thereof such that the interlocked portions prevent the cover from being substantially pushed laterally outward by the spring contacts.

In accordance with another embodiment of the present invention, a card edge connector is provided comprising a base, a cover, and means for moving the cover relative to the base. The base has a housing with a card edge receiving area and a plurality of contacts connected to the housing. The cover is movably mounted to the base and adapted to at least partially move at least some of the contacts. The means for moving can move the cover relative to the base in substantial parallel movement to at least partial movement of a card in the receiving area.

In accordance with another embodiment of the present invention, a card edge connector is provided comprising a base, a cover, and means for moving the cover. The base has a housing with a card edge receiving area and a plurality of contacts connected to the housing. The cover is movably mounted to the base and is adapted to at least partially move at least some of the contacts. The cover is movable between an up position and a down position. The means for moving the cover can move the cover from the down position to the up position as a card is removed from the card edge receiving area. The means for moving includes a portion of the cover being adapted to be engageable with the card and being at least partially moved upward by the card as the card is moved upward.

In accordance with another embodiment of the present invention a card edge connector is provided comprising a base and a cover movably mounted on the base. The base has an elongated housing having a plurality of contacts connected thereto. The cover is adapted to at least partially move at least some of the contacts. The cover has an elongate shape with a card slot in a top surface and having two elongate sides, two end sections connecting the sides, and a center portion extending into the slot and connecting the sides. The center portion is adapted to add rigidity to the cover to prevent substantial lateral deformation of the cover sides by forces exerted on the sides by the contacts.

In accordance with another embodiment of the present invention, a card edge connector is provided comprising a base, a cover, and means for moving the cover. The base has a housing with a card edge receiving slot and a plurality of contacts connected thereto. The cover is movably mounted on the base between an up position and a down position. The cover is adapted to move at least some of the contacts from a retracted position when the cover is in the up position to a card engaging position when the cover is in its down position. The means for moving the cover between the up and down positions include at least one portion of the cover being adapted to be engaged by a portion of a card being moved in the slot to at least partially move the cover with the card.

BRIEF DESCRIPTION OF THE DRAWINGS

The foregoing aspects and other features of the invention are explained in the following description, taken in connection with the accompanying drawings, wherein.

DETAILED DESCRIPTION OF THE INVENTION

Figure 1:
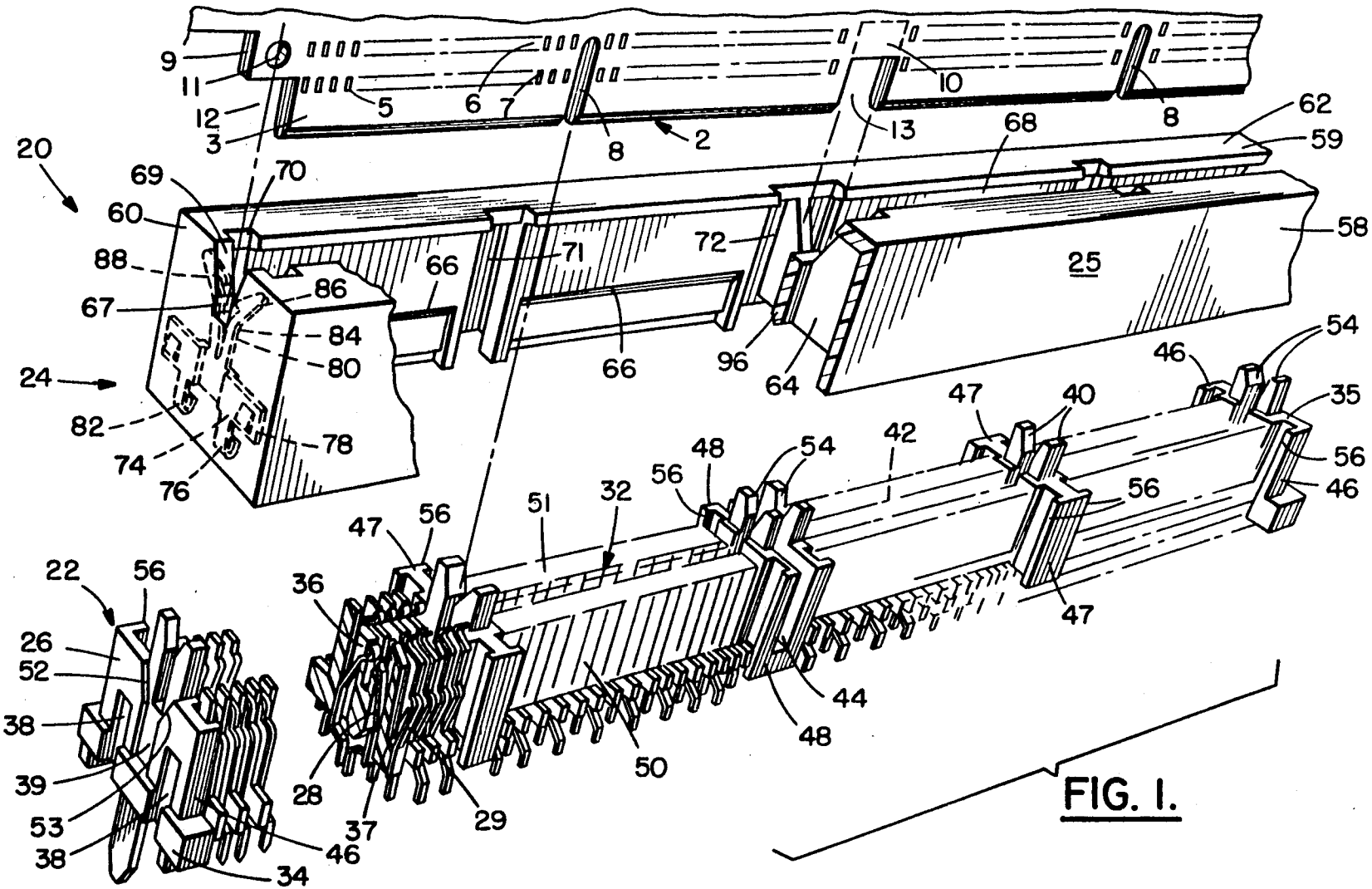
FIG. 1 is a partial exploded perspective view with cut away sections of a card edge connector incorporating features of the present invention and an edge of one type of daughter board card intended to be inserted into the connector.

Referring to FIG. 1, there is shown an exploded perspective view with cut away sections of a card edge connector 20 incorporating features of the present invention. Although the present invention will be described with reference to the embodiments shown in the drawings, it should be understood that many alternate embodiments are possible. In addition, any suitable size, shape or type of elements or materials could be used.

The connector 20, in the embodiment shown, generally comprises a base 22 and a cover 24. The connection 20 is generally provided to connect either a first type of printed circuit daughter board 2 to a mother board (not shown) or a second type of printed circuit daughter board 4 (see FIGS. 2A and 2B) to the mother board. The first type of board or card 2 has a contact edge 3 with two rows of contact pads 5 on opposite sides; an upper row 6 and a lower row 7. The edge 3 also has positioning slots 8 to accurately position the card 2 in the connector 20. In the embodiment shown, the first type of card 2 also has cover contact portions; end contact portions 9 at the ends of the edge 3 and a center contact portion 10 at the center of the edge 3. As noted by dashed lines in FIG. 1, the second type of daughter board 4 does not have these contact portions. The end contact portions 9, in the embodiment shown, also have holes 11 therein for purposes as will be described below. As shown in FIG. 1, slots 12 and 13 in the card 2 are located below contact portions 9 and 10. These slots 12 and 13 are provided to accommodate portions of the cover 24 also as further described below.

The base 22 is generally comprised of a housing 26 and a plurality of two types of contacts mounted to the housing; a first type of contact or lower contacts 28 and a second type of contact or upper contacts 30. The housing 26 is comprised of an electrically insulating dielectric material, such as molded thermoplastic material, with a generally elongate length. A card edge receiving slot 32 extends into the housing 26 between its two end 34 and 36 with contact receiving channels 36 and 37 on opposite sides thereof. In the embodiment shown, the housing 22 also comprises clip grooves 38 and 39 at its ends 34 and 36, card edge guides 40 that extend up from the top 42 of the housing 26, a center slot 44 transverse to the card edge receiving slot 32, and side extensions 46, 47 and 48 that extend laterally away from the sides 50 and 51 of the housing 26. The first type of clip groove 38 has a closed top section. The second type of clip groove 39 has an open top section with ramp surfaces 52 and 53 on opposing sides of the groove 39. The card edge guides 40 are located at predetermined positions on the housing 26 on opposite sides of the card edge receiving slot 32 and have ramp surfaces 54 to guide the edge of a card into the slot 32. The side extensions include end extensions 46 at ends 34 and 35 that have a lip 56, intermediate extensions 47 that have a general T-shaped cross-section with lips 56, and center extensions 48 with the center slot 44 passing therethrough that also have lips 56.

Figure 2A:
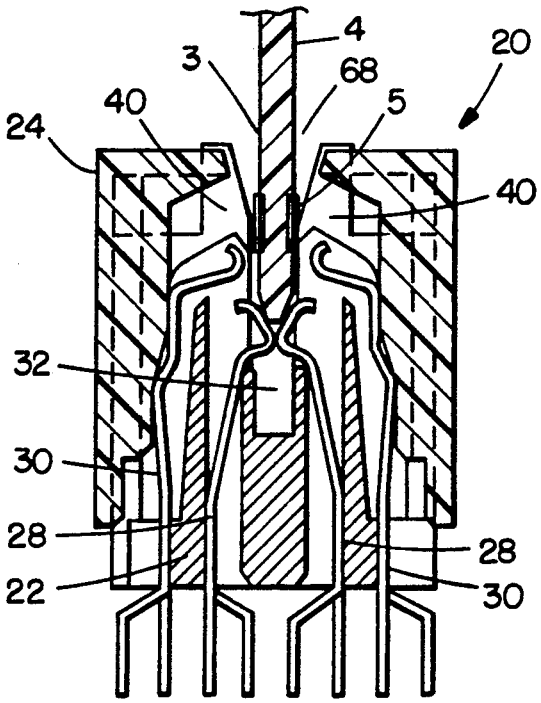
FIG. 2A is a cross sectional view of the connector shown in FIG. 1 with the cover in its up position and a second type of daughter board being inserted thereinto.
Figure 2B:
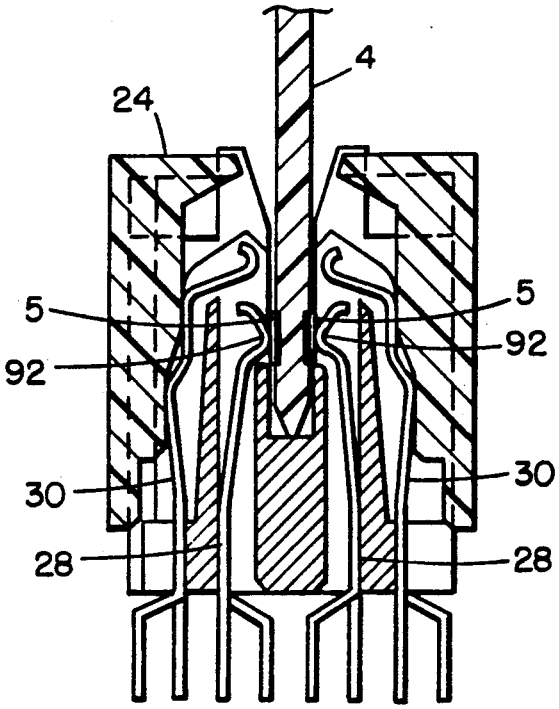
FIG. 2B is a cross sectional view as in FIG. 2A with the daughter board having been fully inserted into the connector.

Referring also to FIGS. 2A and 2B, the contacts 28 and 30 can be better seen with the connector 20 in its assembled state and with the cover 24 in its up position. In the embodiment shown, the cover 24 is movably mounted on the base 22 between an up position and a down position. The contacts 28 and 30 are comprised of metal or metal alloy and are provided with solder tails 90 and 91 for connection to a mother printed circuit board (not shown). The contacts 28 and 30 also comprise contact areas 92 and 93 for contacting contact pads 5 on an inserted daughter printed circuit board. In the embodiment shown, the cover 24 is biased in an up position until such time as a first type of card is inserted into the connector 20. The lower contacts 28 have their contact areas 92 located in the card edge receiving slot 32 in a home position with no card inserted into the slot 32. The upper contacts 30, on the other hand, have their contact areas 93 located out of the card edge receiving slot 32 in a home position when there is no card inserted into the slot 32. The lower contacts 28 can have their top sections deflected back by an inserted daughter board card such that contact pads on the card can contact the contact areas 92. The upper contacts 30 have ramp surfaces 94 that contact the interior surfaces of the sides 50 and 51 of the cover 24 and are adapted to be moved by the contact ramps 66 as the cover 24 is moved relatively to the base 22.

The cover 24 is generally comprised of a housing 25 and two end clips 74. The cover housing 25 is also comprised of an insulating dielectric material and has a general elongate length with elongate sides 58 and 59, ends 60, and a top surface 62. The cover 24 also comprises a center web 64 between the sides 58 and 59, contact ramps 66 on interior surfaces of the cover sides 58 and 59, a center slot 68 through the top surface 62, and extension receptacles 70, 71 and 72 along the sides 58 and 59 to accommodate the base extensions 46, 47 and 48. The two end clips 74 are mounted to the inside of the ends 60 and generally have a lower section 76, a middle section 78 and an upper section 80. The lower section 76 includes two hooks 82. The upper section 80 has two legs 84 that extend up from the middle section in general cantilever fashion and each has a ramp surface 86 and a hook surface 88.

As noted above, the connector 20 is adapted to be used with either a first or a second type of daughter printed circuit board. FIGS. 2A and 2B show the connector 20 and its interaction with a second type of printed circuit board 4. The second type of daughter board 4 is similar to the first type of daughter board 2. However, the second type of daughter board 4 has only one row of contact pads 5 on each side. In addition, the second type of daughter board does not have cover contact portions 9 and 10, but rather, the slots 12 and 13 extend all the way up the edge of the card (as shown in dashed lines in FIG. 1).

As can be seen in FIG. 2A, initially the edge 3 of the card 4 is inserted through the center slot 68 in the cover 24 and is guided into the card edge receiving slot 32 by the guides 40. Upon contact with the lower contacts 28, the card 4 can be further pushed to wedge the lower contacts 28 back from the center axis of the slot 32. As the card 4 is further pushed into the connector 20, it eventually reaches a fully inserted position as shown in FIG. 2B with the contact areas 92 of the lower contacts 28 contacting the contact pads 5 of the card 4, but the upper contacts 30 are kept spaced from the card 4 and the card 4 has not moved the cover 24 from its up position. Basically, the cover 24 is maintained in its up position due to the biasing action of the upper contacts 30 between the ramp surfaces 94 and contact ramps 66 in the cover 24. The cover 24 can only be moved down by moving the upper contacts 30 from their home position to a daughter board contact position. However, any suitable type of means for keeping the cover in its up position could be provided. One type of alternate embodiment is described below with reference to FIGS. 8 and 9. The cover 24 is suitably sized and shaped with slot 68 in its top 62 and end slots 69 and, the second type of daughter board 4 having enlarged slots 12 and 13, that the second type of daughter board 4 does not contact the cover 24. Therefore, the cover 24 cannot be moved by the card 4 and stays in its up position during use with the card 4.

Figure 3A:
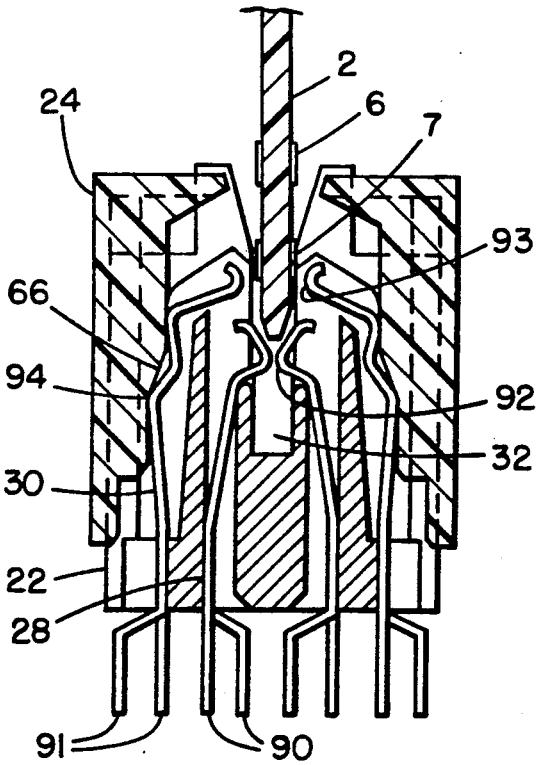
FIG. 3A is a cross sectional view of the connector shown in FIG. 1 with the cover in its up position and the first type of daughter board being inserted thereinto.
Figure 3B:
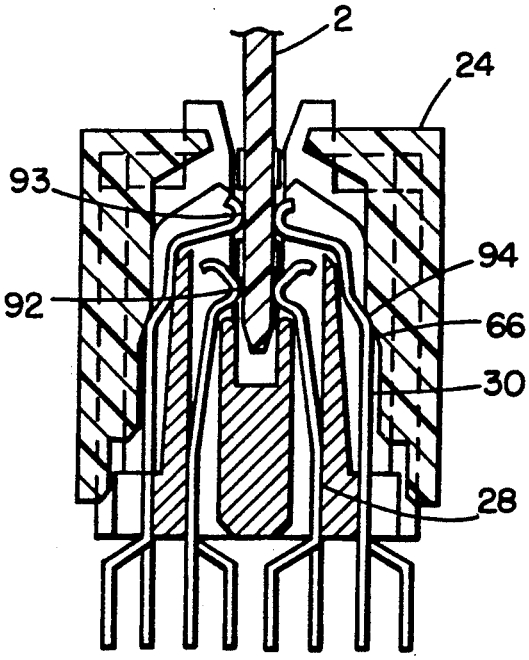
FIG. 3B is a cross sectional view of the connector and daughter board as in FIG. 3A wherein the cover has been moved partially downward by the first type of daughter board.
Figure 3C:
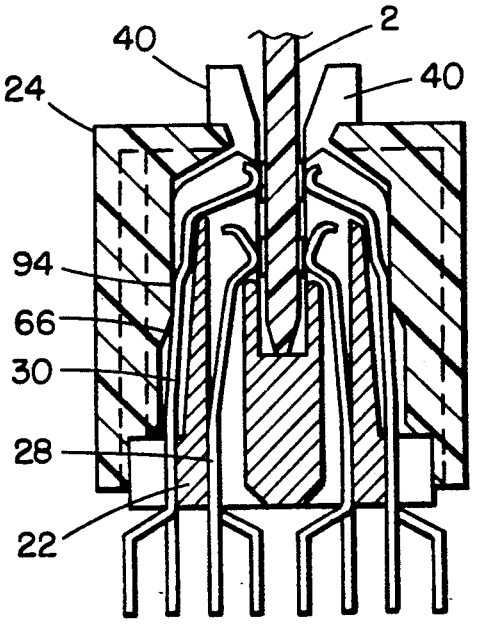
FIG. 3C is a cross sectional view as in FIGS. 3A and 3B wherein the first type of daughter board has been fully inserted into the connector and the cover has been moved to its down position.

Referring now also to FIGS. 3A, 3B and 3C, the operation of the connector 20 with connection of the first type of daughter board 2 will be described. As noted above, unlike the second type of daughter board 4, the first type of daughter board 2 has two rows of contact pads; upper rows 6 and lower rows 7. In addition, the first type of daughter board 2 has cover contact portions 9 and 10 . The center contact portion 10 is adapted to contact center portion 96 of web 64. The end contact portions 9 are adapted to contact ledges 67 at the base of end slots 69 in the ends 60 of the cover 24. During insertion of the first type of card 2 into the connector 20, the upper contacts 30 remain spaced from the card 2 as the edge 3 of the card 2 wedges the contact areas 92 of the lower contacts 28 back. However, during this insertion, the contact portions 9 and 10 of the card 2 contact the ledges 67 and web center portion 96 of the cover 24, and the cover 24 is pushed down with the card 2. The slots 12 and 13 in the card 2 are provided as timing slots to accurately move the cover 24 with the card 2 only after the card edge 3 has been partially inserted into the connector 20. However, any suitable means for timing the movement of the cover 24 relative to insertion of the card 2 can be provided. In addition, any suitable means of timing movement of the upper contacts 30 can also be provided. As the cover 24 moves down, the contact ramps 66 force the contact areas 93 of the upper contacts in towards the card 2. In a preferred embodiment, the contact areas 93 of the upper contacts 30 contact the card 2 between the rows 6 and 7 of contact pads 5. With this preferred embodiment, the upper contacts don't touch the lower rows 7 of contact pads 5, but are allowed to scrub against the upper rows 6 of contact pads 5 as the card 2 is further inserted. FIG. 3C shows the connector 20 and the first type of card 2 in a fully inserted position and the cover 24 in its down position. As can be seen, the lower contacts 28 contact the lower rows of contact pads 7 and the upper contacts 30 contact the upper rows 6 of contact pads. In the cover down position shown, the ramp surfaces 94 of the upper contacts 30 are located above the contact ramps 66 of the cover 24. Thus, virtually all the forces exerted between the cover 24 and the upper contacts 30 is lateral. Hence, the upper contacts do not tend to push the cover up and, the cover can remain at its down position without any additional position retainment other than the frictional retainment of the cover by the upper contacts. However, additional position retainment means could be provided.

Figure 4:
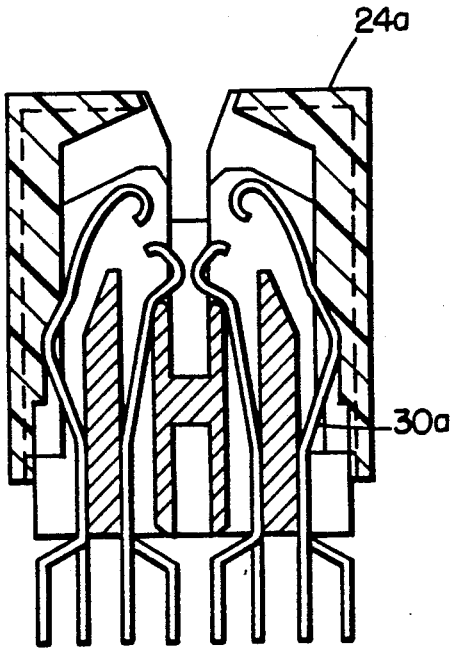
FIG. 4 is a cross sectional view of an alternate embodiment of the present invention.

As can be noted from the above described embodiment of the invention, the connector 20 has numerous features and advantages over the prior art. The connector 20, unlike ZIF connectors, does not need an operator or user to perform two tasks to properly connect a card into a connector. The connector 20 only requires the inserter to perform one operation, to merely insert the card into the card receiving slot. In addition, unlike ZIF connectors, the connector 20 allows the contact pads 5 on the cards to be scrubbed or wiped as the cards are inserted to provide for better contact between the contacts and the card. A further advantage of the present invention, unlike prior art duel purpose card edge connectors, the connector 20 allows "full" insertion of both types of daughter printed circuit boards (with one level of contact pads or two levels of contact pads) into the card edge receiving slot and not merely partial insertion such as in U.S. Pat. No. 4,869,672. Also unlike the prior art, the primary contacts in the connector 20 (i.e.: the contacts that are contacted by both types of daughter board cards) is the lower level of contacts 28, not an upper level. Also unlike the connectors in the prior art, the lower contacts 28 are not influenced by movement of the cover 24. Only the upper contacts 30 are moved by the movement of the cover 24. Only the upper contacts 30 are moved by the movement of the cover 24. In addition, the upper contacts 30 are positioned in the base housing 26 such that they are normally spaced from the card edge receiving slot 32 and must be deformed and forced in towards the slot 32 in order to make contact with a card. FIG. 4 shows one alternate embodiment of the connector 20. In the embodiment shown, the upper contacts 30*a* have a slightly different shape, as does the interior walls of the cover 24. Basically, this embodiment is shown to illustrate that various changes in the shapes of the elements can be incorporated into the invention. In addition, the present invention may be combined with other features including a slot positioner as disclosed in U.S. Pat. No. 4,869,672, or a ZIF lever actuated mechanism. The present invention may also be used with any number of levels of contacts including one, two, three, or more. The present invention may also be used to allow a connector to be used with three or more different types of daughter board printed circuit cards.

Figure 5A:
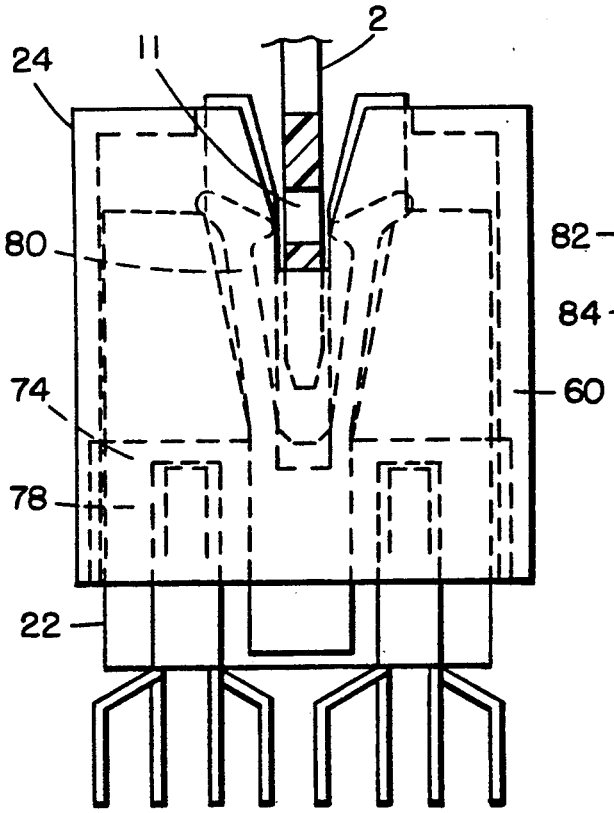
FIG. 5A is an end view of the connector shown in FIG. 1 with the cover in its up position.

Referring also to FIGS. 5A, B and C, the function and operation of the end clips 74 will now be described. The clips 74 are preferably unitary members made of a suitable material such as metal. The middle section 78 is fixedly connected to the interior side of the end wall 60 such that the clips 74 move with the cover. The hooks 82 of the lower section 76 are used as a means to limit upward movement of the cover 24 relative to the base 22. The hooks 82 can slide up and down in grooves 38 in the base housing 26 and stop the cover 24 from further movement upward when they contact the tops of the grooves 38. The legs 84 of the upper section 80 have a general V-shaped profile relative to each other in a home position with the cover up, but can be deflected inward towards each other. As noted above, the ends 34 and 35 of the base housing 26 have a second type of groove 39. Each of the these grooves 39 have a bottom narrow section 98 and a top tapered section 100. The clip upper section 80 is located in the groove 39.

Figure 5B:
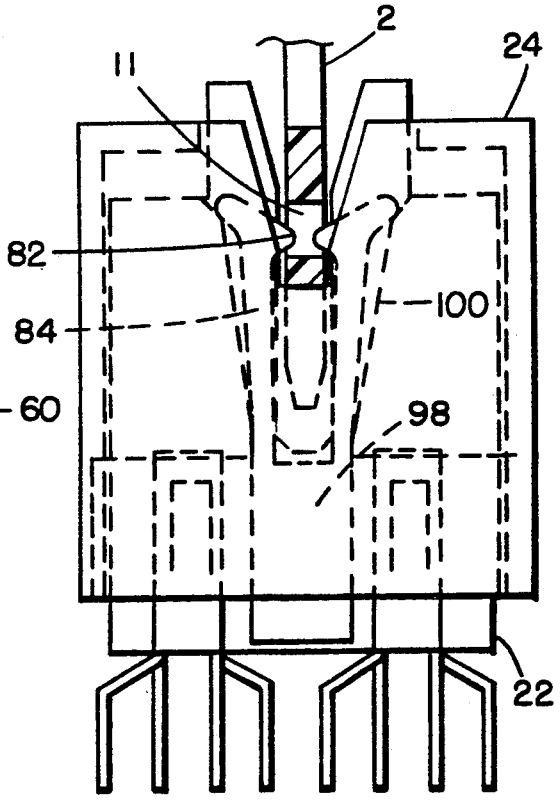
FIG. 5B is an end view as in FIG. 5A with the cover having been partially moved down by insertion of the first type of daughter board into the card edge receiving slot.
Figure 5C:
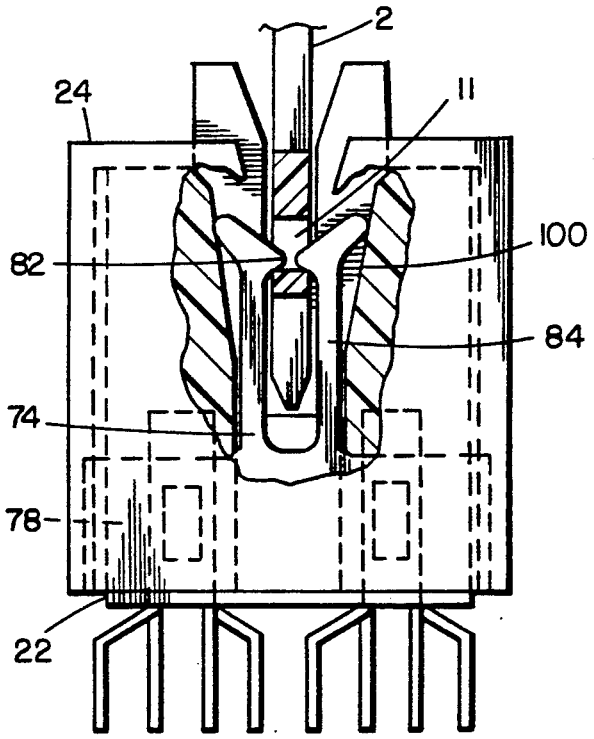
FIG. 5C is an end view as in FIGS. 5A and 5B with a cut away section showing an end clip and the cover being located in its down position.

FIG. 5A shows the location and position of a clip 74 with the cover 24 in its up position. The clip upper section 80 has its legs 84 resting against the tapered section 100. This helps to keep the cover 24 in its up position relative to the base 22. In the event the second type of card 4 is inserted into the connector 20, because the cover 24 does not move relative to the base 22, the position and location of the clips 74 do not change. Upon insertion of the first type of printed circuit board 2 into the connector 20, the position and location of the end clips 74 do change. As seen in FIG. 5B, because the middle section 78 of the clip 74 is fixedly connected to the cover 24, as the cover 24 is moved down by the card 2, the clip 74 is also moved down relative to the base 22. Because the upper section 80 of the clip 74 is in groove 39 and the upper portion 100 is tapered, the legs 84 of the clip 74 are wedged in towards each other as the cover moves down. Because the cover 24 moves downward with the card 2, the relative movement allows the hook surfaces 88 to move into the holes 11 in the card 2. In the fully inserted position as shown in FIG. 5C, the hook surfaces 88 rest inside the hole 11 and adjacent the interior of the hole.

The end clips 74 are generally provided to function as a means for insuring that the cover 24 is automatically moved upward when the card 2 is removed from its down position in the connector 20. This insures that the cover 24 does not get suck in its down position and thus prevents the upper contacts 30 from inadvertently touching the lower level of contact pads 7. This also makes removal of the card 2 easier because, as the cover is partially moved up by the card 2 and clips 74, the ramp surfaces 94 of the upper contacts 20 come into contact with and push against the ramps 66 on the cover 24 to push the cover up. Because cover ledges 67 and 96 interact with the bottom of the card 2, the cover 24 can push up on the card to help remove it from the grasp of the lower contacts 28. If the hole 11 and end clips 74 are properly design, an alternate embodiment can include the card 2 preventing the clips 74 from moving upward except when the card 2 is moved upward. Thus, the cover 24 would be prevented from moving upward except when the card 2 is moved upward. Obviously, additional or alternative means to prevent the cover 24 from moving from its down position except when the card 2 is moved can be provided including automatic or manual means.

Figure 6:
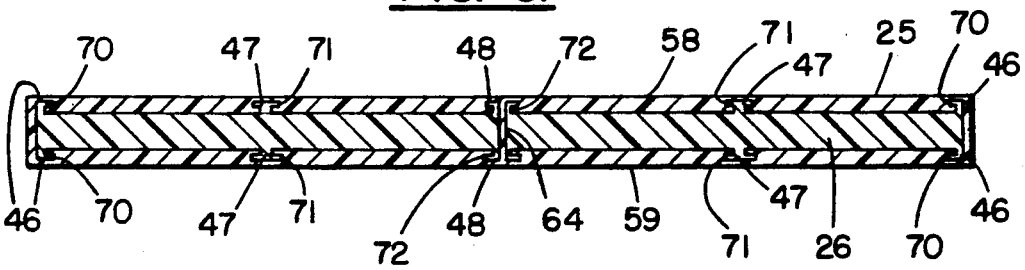
FIG. 6 is a schematic cross sectional view of the connector shown in FIG. 1 showing the interlocking relationship and lateral support of the cover on the base.

Referring also to FIG. 6, the lateral support of the cover 24 will now be described. As noted above, as the cover 24 is pushed down by the card 2, a lateral force is exerted on the upper contacts 30 by the sides 58 and 59 of the cover 24. Obviously, an equal force is exerted on the cover 24. Because the connector 20 can have several hundred contacts, such as over 600 contacts, the lateral forces exerted on the cover sides 58 and 59 could be several hundred pounds. Because the cover housing 25 is preferably only made of a molded plastic or polymer material that is slightly flexible and, the cover housing 25 has an elongate length, lateral support is provided to the cover housing 25. In the embodiment shown, there are two types of lateral support provided. The first type of support is provided by the center web 64 that extends in the center of the cover housing 25 between the two sides 58 and 59. This significantly reduces deflection of the cover sides 58 and 59 away from the base housing 26. The second type of support is provided by the side extensions 46, 47, and 48 and the extension receptacles 70, 71, and 72. As noted above, the side extensions 46, 47, 48 slidingly fit inside the receptacles 70, 71, 72 such that the cover 24 can move up and down on the base 22. The lips 56 of the extensions fit in the receptacles to help prevent the sides 58 and 59 of the cover housing 25 from being pushed out from the base 22. This lateral support is preferred to insure that the upper contacts 30 exert proper contact stress on the contact pads 5 of the card 2.

Figure 7:
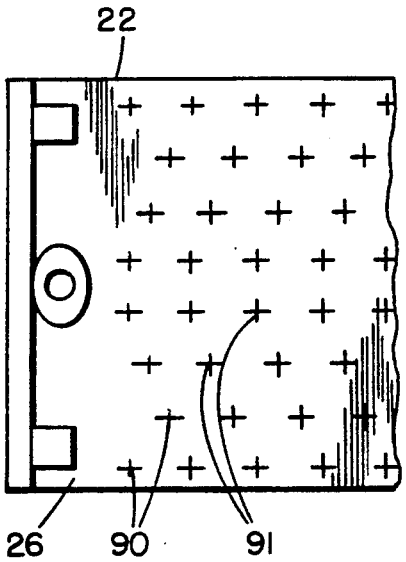
FIG. 7 is a partial schematic view of the solder tail layout of the connector shown in FIG. 1.
Figure 8:
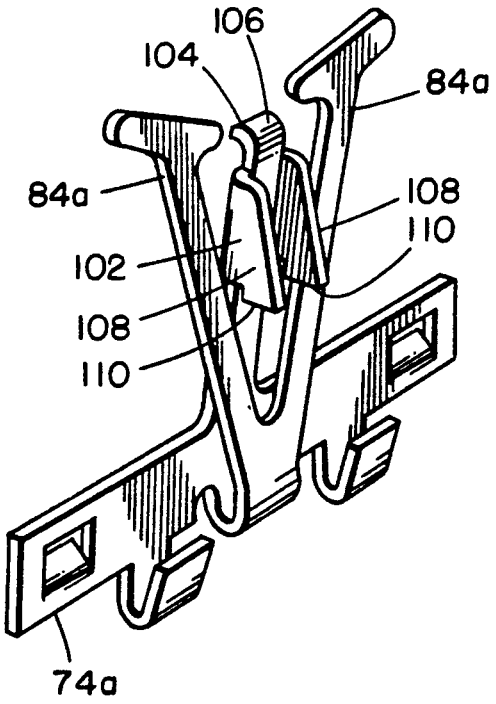
FIG. 8 is a perspective view of an alternate embodiment of an end clip.
Figure 9:
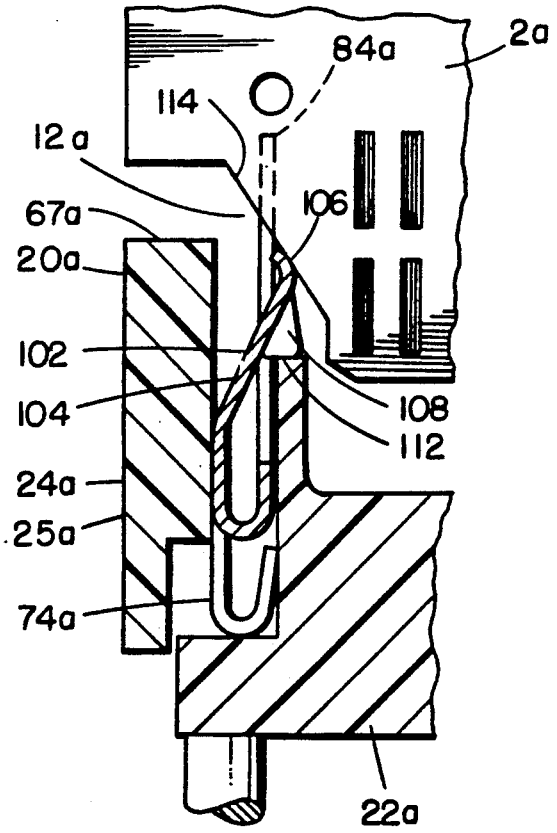
FIG. 9 is a schematic partial cross-sectional view of one end of a connector incorporating the end clip shown in FIG. 8.

Referring also to FIG. 7, a partial schematic bottom view of one end of the connector 20 is shown. The solder tails 90 and 91 are shown in a general V shaped profile from side to side of the connector. Signal contacts can be intermixed with ground contacts to provide shielding and proper signal transmission. An alternate embodiment could include a straight diagonal pattern of solder tails from side to side which might be preferable for purposes such as proper mother board circuit path layout. However, any suitable solder tail pattern could be provided. In addition, any suitable mother board contact sections could be provided on the contacts, not necessarily solder tails. Referring also to FIGS. 8 and 9 an alternate embodiment of an end clip **74*a* is shown and a partial view of a connector 20*a* and card 2*a* that are used with the end clip 74*a* is shown. The clip 74*a* is very similar to the clip 74 shown in FIGS. 1, 5A, 5B and 5C. However, the clip 74*a* also comprises lock portion 102. The lock portion 102, in the embodiment shown, is generally adapted to keep the cover 24*a* in a locked up position until a first type of card 2*a* is inserted into the connector 20*a***.

The clip **74*a* shown in FIGS. 8 and 9 generally comprises a deflectable cantilevered center leg 104 that is angled in a home position to project between legs 84*a*. The clip 74*a* has a top cam surface 106 and two stems 108 with substantially flat bottom surfaces 110. The base 22*a* has a ledge 112 at each end that the flat bottom surfaces 110 are intended to make contact with while the cover 24*a* is in its up position. Since the clips 74*a* are connected to the cover 24*a* at each end, and the clips 74*a* contact the top of the ledges 112 while the cover 24*a* is in an up position, the cover 24*a* is prevented from moving down on the base 22*a* unless the legs 104 are first deflected off of the ledges 112**.

In order to move the legs 104 off of the base ledges 112, or unlock the cover **24*a* from its up position such that the cover 24*a* can be moved down, the first type of card 2*a* has an angled or wedge surface 114 at its end slots 12*a*. These wedge surfaces 114 are adapted to contact the top cam surface 106 of the lock legs 104 and push the lock legs 104 outward as the card 2*a* is inserted into the cover 24*a*. As the lock legs 104 are wedged outward by the card 2*a*, the stems 108 are moved away from the ledges 112. Thus, when the card 2*a* contacts the cover housing 25*a* at ledges 67*a*, the locking engagement between the clip lock leg 104 at each end has been disengaged. This allows the cover 24*a*, with attached end clips 74*a*, and card 2*a* to move down together relative to the base 22*a*. In a preferred embodiment, the stems 108 are suitably spaced from each other to allow a portion of the card 2*a* to be positioned therebetween. However, any suitable cover locking system could be provided. Because the second type of card would be adapted not to contact lock legs 104, the end clips 74*a* would retain the cover 24*a* in a locked up position relative to the base 22*a* when the connector 20*a*** is used with a second type of card. Thus, the upper contacts would remain spaced from the contact pads of the second type of card to prevent any type of misconnection.

Let it be understood that the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. A card edge connector comprising:

a base having a housing comprised of electrically insulating material and spring contacts connected thereto, said base housing having a card edge receiving slot therein;

a cover comprised of electrically insulating material movably mounted on said base between a first position and a second position, said cover having means for moving at least some of said spring contacts relative to said card edge receiving slot; and means for moving said cover on said base upon insertion and removal of a daughter board card with said card edge receiving slot, said means for moving comprising at least one portion of said cover being adapted to be interactively contacted by the daughter board card and moved thereby.

2. A connector as in claim 1 wherein said cover comprises card ledges for a card to push on said cover.

3. A connector as in claim 1 further comprising means for biasing said cover in a first position relative to said base.

4. A connector as in claim 3 wherein said means for biasing comprises at least some of said spring contacts pushing on said cover.

5. A connector as in claim 1 wherein said spring contacts are comprised of a first type of spring contact and a second type of spring contact, said first type of spring contact projecting into said slot at a home position and said second type of spring contact being spaced from said slot in a home position, but adapted to be moved into said slot by movement of said cover.

6. A connector as in claim 5 wherein said first type of contacts are lower contacts and said second type of contacts are upper contacts.

7. A bi-level card edge connector adapted to be used in connecting a mother board with a daughter board of either a first type or a second type, the connector comprising:

a housing having a card edge receiving area;

spring contacts mounted to said housing, said spring contacts including upper contacts proximate an upper region of said card edge receiving area and, lower contacts proximate a lower region of said card edge receiving area;

means for allowing said lower spring contacts to contact both the first and second types of daughter boards upon insertion of one of the boards into said receiving slot; and means for allowing said upper spring contacts to contact the first type of daughter board and for preventing said upper spring contacts from contacting the second type of daughter board upon insertion of one of the boards into said receiving slot.

8. A connector as in claim 7 further comprising a cover movably mounted on said housing and adapted to engage said upper spring contacts.

9. A connector as in claim 7 further comprising means for allowing full depth insertion of the first and second types of daughter boards into said receiving area.

10. A connector as in claim 7 wherein said means for allowing said lower spring contacts to contact the first and second types of daughter boards comprises:

said lower contacts being positioned in said receiving area at a home position.

11. A connector as in claim 7 wherein said means for allowing said upper spring contacts to contact the first type of daughter board and for preventing said upper spring contacts from contacting the second type of daughter board comprises:

said upper contacts being movable into and out of said receiving area dependent upon the type of daughter board being inserted.

12. A multi-level card edge connector adapted to be used in making mechanical and electrical connection between a mother board and a daughter board of either a first type or a second type, the connector comprising:

a housing comprised of dielectric material having a card edge receiving area;

spring contacts mounted to said housing, said spring contacts including a first type of contact projecting into said receiving area in a home position and a second type of contact being spaced from said receiving area in a home position;

means for selectively moving said second type of contact into said card edge receiving area upon insertion of the first type of daughter board into said receiving area, but allowing said second type of contact to remain spaced from said receiving area upon insertion of the second type of daughter board into said receiving area.

13. A connector as in claim 12 wherein said means for selectively moving comprises a cover movably mounted on said housing.

14. A connector as in claim 13 wherein said cover comprises cam surfaces adapted to push said second types of contacts in towards said receiving area as said cover is moved.

15. A daughter board edge connector comprising:

a base having a housing with a longitudinal shape and a card edge receiving slot and, spring contacts connected thereto;

a cover having a longitudinal length and being movably mounted on said base housing and adapted to move at least some of said spring contacts relative to said receiving slot; and means for laterally supporting said cover along its length comprising predetermined portions of longitudinal sides of said cover being interlocked with predetermined portions of adjacent longitudinal sides of said base such that said interlocked portions prevent said longitudinal sides of said cover from being substantially pushed laterally outward by said spring contacts.

16. A connector as in claim 15 wherein said means for laterally supporting includes a portion of said cover forming a center web between two sides of said cover.

17. A connector as in claim 16 wherein said base comprises a slot to accommodate said web.

18. A connector as in claim 15 wherein predetermined portions include generally T-shaped columns and slots on said sides.

19. A card edge connector comprising:

a base having a housing with a card edge receiving area and a plurality of contacts connected to said housing;

a cover movably mounted to said base and adapted to at least partially move at least some of said contacts; and means for automatically moving said cover relative to said base with a card as the card is being inserted into the base and in substantial parallel movement with movement of the card in said receiving area whereby said contacts are moved as said cover and the card are moved.

20. A connector as in claim 19 further comprising means for preventing said cover from moving from a set position except with insertion of the card in said receiving area.

21. A connector as in claim 19 further comprising means for limiting movement of said cover relative to said base.

22. A connector as in claim 19 wherein said cover comprises a cam surface to move said contacts.

23. A connector as in claim 19 further comprising means for preventing said cover from moving from a set position except with withdrawal of the card from said receiving area.

24. A card edge connector comprising:

a base having a housing with a card edge receiving area and a plurality of contacts connected to said housing;

a cover movably mounted to said base and adapted to at least partially move at least some of said contacts, said cover being movable between an up position and a down position; and means for moving said cover from said down position to said up position as a card is removed from said card edge receiving area, said means for moving including a portion of said cover being adapted to be engageable with the card and being adapted to be at least partially moved upward by the card as the card is moved upward.

25. A connector as in claim 24 wherein said portion comprises clips that have deflectable arms adapted to project into holes in a card when the card is inserted into said receiving area.

26. A connector as in claim 25 wherein the clips are adapted such that withdrawal movement of the card from its fully inserted position in the connector moves said clips and a cover housing.

27. A connector as in claim 25 wherein each of said clips are comprised of a unitary member.

28. A card edge connector comprising:

a base having an elongate housing and a plurality of contacts connected thereto; and a cover movably mounted on said base and adapted to at least partially move at least some of said contacts, said cover having an elongate shape with a card slot in a top surface and having two elongate sides, two end sections connecting said sides, and a center portion extending into said slot and connecting said sides, said center portion adapted to add rigidity to said cover to prevent substantial lateral deformation of said cover sides by forces exerted on said sides by said contacts.

29. A connector as in claim 28 wherein said base has a slot to accommodate said center portion.

30. A card edge connector comprising:

a base having a housing with a card edge receiving slot and a plurality of contacts connected thereto;

a cover movably mounted on said base between an up position and a down position, said cover being adapted to move at least some of said contacts from a retracted position when said cover is in said up position to a card engaging position when said cover is in said down position; and means for moving said cover between said up and down positions including at least one portion of said cover being adapted to be engaged by a portion of a card being moved in said slot to at least partially move said cover with the card.

31. A card edge connector comprising:

a base having a housing with a card edge receiving area and a plurality of contacts connected to said housing;

a member movably mounted to said base and adapted to at least partially move at least some of said contacts;

means for moving said member relative to said base as a card is moved in said receiving area; and means for preventing said member from moving from a set position except with withdrawal of the card from said receiving area.

* * * * *